US006081970A

United States Patent [19]

Wasilewski

[11] Patent Number: 6,081,970

[45] Date of Patent: Jul. 4, 2000

[54] RAPID MOUNTING HINGE CUP FOR FURNITURE HINGES

[75] Inventor: Wladyslaw Wasilewski, Köln, Germany

[73] Assignee: Prämeta Gesellschaft für Prazisionmetall-und Kuntstofferzeugnisse mbH & Co. KG, Cologne, Germany

[21] Appl. No.: 09/028,346

[22] Filed: Feb. 24, 1998

[30] Foreign Application Priority Data

Feb. 24, 1997 [DE] Germany ..... 297 03 227 U

[51] Int. Cl.[7] ..... E05D 5/00

[52] U.S. Cl. ..... 16/383

[58] Field of Search ..... 16/383, 384, 272, 16/271, 382, 254

[56] References Cited

U.S. PATENT DOCUMENTS 4,361,931 12/1982 Schnelle et al. .
5,463,796 11/1995 Brustle et al. .
5,548,870 8/1996 Grass ..... 16/382
5,586,364 12/1996 Ferrari et al. ..... 16/383
5,715,577 2/1998 Lautenschlager et al. ..... 16/383

FOREIGN PATENT DOCUMENTS 0552607 1/1993 European Pat. Off. .
4427293 8/1994 Germany .

*Primary Examiner*—Chuck Y. Mah
*Attorney, Agent, or Firm*—Diller, Ramik & Wight, PC

[57] ABSTRACT

In a rapid mounting hinge cup for furniture hinges, comprising a cup body (2) adapted for insertion into a cup bore (4) of a piece of furniture (6) and for being locked in the cup bore (4) by radially extending the diameter of the cup body, it is provided that said cylindrical cup body (2) comprises two mirror symmetric cup halves (8, 9) connected with each other on one side in the peripheral area, the plane of symmetry of the cup halves extending in a plane including the center axis of the cup bore (4), and further comprising a spreader element (14) spreading the cup halves (8, 9) apart and being provided between the cup halves.

19 Claims, 6 Drawing Sheets

RAPID MOUNTING HINGE CUP FOR FURNITURE HINGES

FIELD OF THE INVENTION

The present invention is directed to a rapid mounting hinge cup for furniture hinges, comprising a cup body adapted for insertion into a cup bore of a piece of furniture and for being locked in the cup bore by radially extending the diameter of the cup body.

BACKGROUND OF THE INVENTION

Such a rapid mounting hinge cup is known, e.g., from German Patent 44 27 293 A. This known rapid mounting hinge cup comprises a rotatable or pivotable operating element which, when being rotated or pivoted, allows for a change in the cross section of the rapid mounting hinge cup, the change being effected by the displacement of spreader segments.

Another hinge cup, known from U.S. Pat. No. 5,463,796, comprises clamping jaws having the shape of cylinder segments and being adapted to be pressed against the cup bore through an eccentric lever and expanding members in the form of tie rods.

It is a disadvantage of both known rapid mounting pots that they require a large number of parts, i.e. at least eight, so that the manufacturing and mounting efforts are considerable.

It is an object of the present invention to provide a rapid mounting hinge cup that can be made up from a small number of pieces and can be manufactured at low cost as a molded member.

SUMMARY OF THE INVENTION

According to the present invention, the object is solved with a cylindrical cup body comprising two diametrically divided cup halves connected with each other on one side in the peripheral area and further comprising a spreader element spreading the cup halves apart and being provided between the cup halves.

The cup body may be formed integral with the cup halves and the spreader element, or the spreader element can be provided as a separate member. When the spreader element is pulled or pushed between the two cup halves, the cup halves are spread apart so that the diameter of the cup body is expanded.

Preferably, the spreader element spreads the cup halves apart through a tensioning element. Using the tensioning element, the spreader element may be pressed against the cup halves or it may be released therefrom to remove the rapid mounting hinge cup.

In a particularly preferred embodiment, the cup halves are interconnected in the peripheral area through a web, the spreader element spreading apart the cup halves while deforming the web. In this case, the cup halves, the web and the spreader element may be formed as molded or injection molded parts, or they may be provided as two or three parts.

In a preferred embodiment, the spreader element projects from the web in the manner of a tongue. With this embodiment, the cup body may be formed integral with the spreader element.

The tensioning element may be supported in the spreader element and may brace the spreader element and the cup halves against each other.

Preferably, the cup halves and the spreader element have mutually adapted beveled surfaces. The beveled surfaces facilitate the spreading apart of the cup halves, since they generate a radially acting force when bracing of the spreader element and the two cup halves against each other.

The tensioning element may be a screw for screwing into the spreader element, supported at the cup halves and thereby bracing the spreader element against the cup halves.

The beveled surfaces may be provided with a groove structure, the grooves of the respective surfaces interengaging under pressure and self-actingly locking the respective spread position of the cup halves.

The cup body may be provided with a usual flange having at least one centering pin. The centering pin may engage a corresponding recess in the respective piece of furniture and constitute a contrivance against position changes and rotation.

In cup bores open at one side, the cup body may be provided with edge protection strips.

The outer surfaces of the cup body may comprise cupped gripping points of sawtooth-like section that engage the piece of furniture when the cup halves are spread apart in the cup bore.

BRIEF DESCRIPTION OF THE DRAWINGS

The following is a detailed description of embodiments of the invention taken in conjunction with the accompanying drawings.

In the Figures.

DETAILED DESCRIPTION OF PREFERRED EMBODIMENTS OF THE INVENTION

Figure 1:
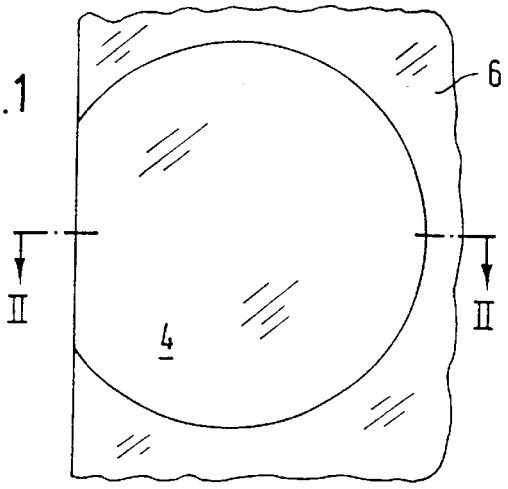
FIG. 1 illustrates a cup bore in a door wing.

Referring now to the Figures, FIG. 1 illustrates a cup bore 4 for a rapid mounting hinge cup in a piece of furniture 6, e.g. a door wing. In this case, the cup bore 4 is open towards the inner edge 12 of the door.

Figure 2:
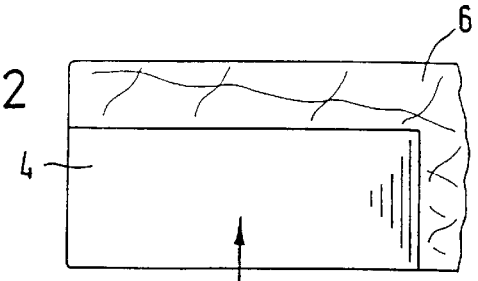
FIG. 2 shows a sectional view taken along line II—II in FIG. 1.
Figure 3:
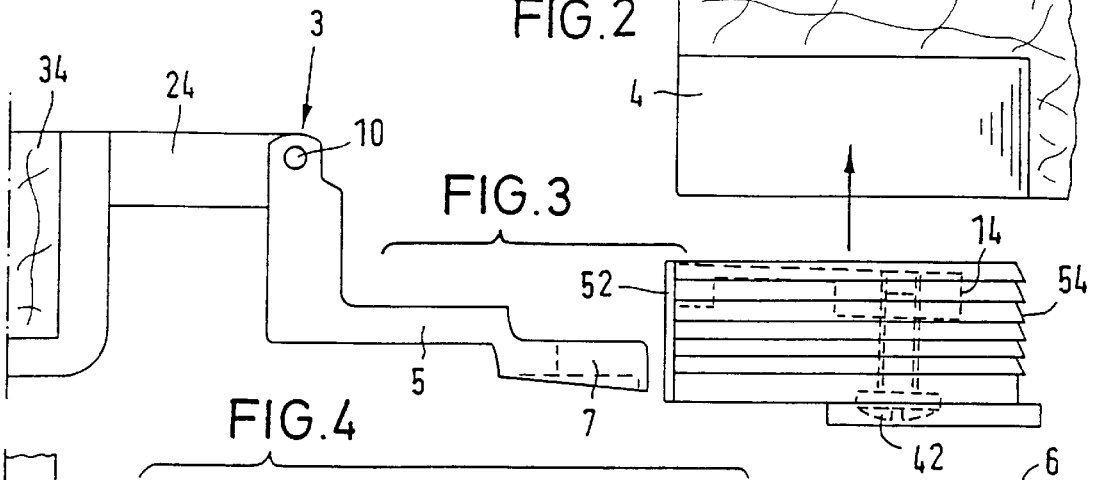
FIG. 3 illustrates a single axis hinge for fastening in the cup body.

FIG. 2 shows a sectional view along line II—II in FIG. 1, and FIG. 3 schematically illustrates how the cup body 2 of the rapid mounting hinge cup is installed in the bore 4. The cup body 2 has its outer surface provided with cupped gripping points 54 arranged in a sawtooth-like manner, when seen in cross section, such that the cup body 2 may easily be pushed into the cup bore 4, but may not be pulled out that easily, since the cupped gripping points 54 get hooked in the piece of furniture 6.

Figure 4:
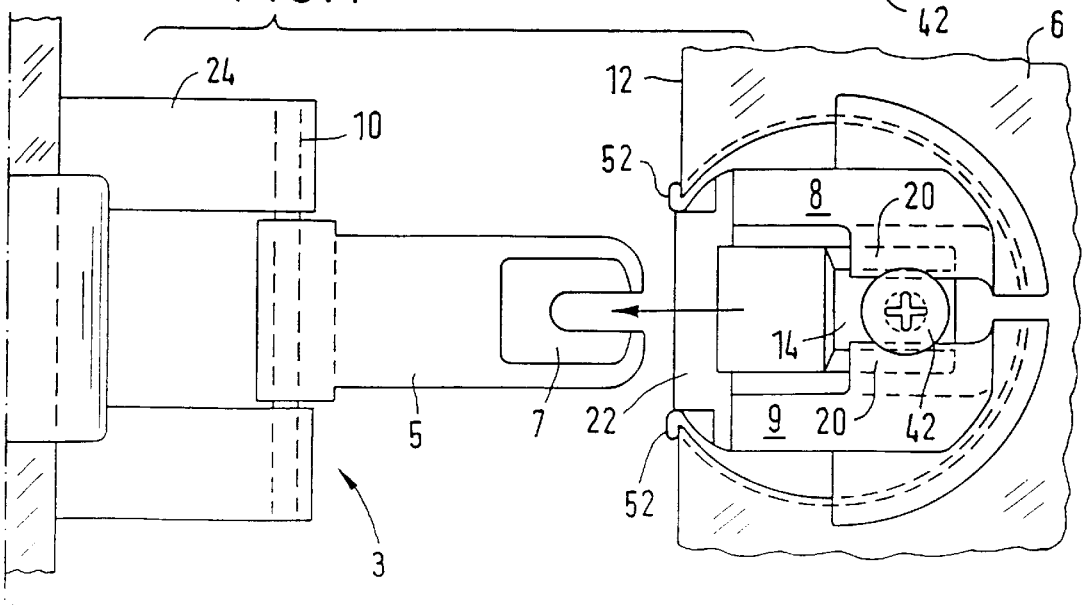
FIG. 4 is a top plan view on FIG. 3.

As is best seen in FIG. 4, an edge protecting strip 52 of the cup body 2 is provided at the door edge 12 of the piece of furniture 6, respectively, preventing damage to the piece of furniture 6, on the one hand, and forming a contrivance against rotation of the cup body 2, on the other hand.

FIGS. 3 and 4 illustrate how the piece of furniture 6, in this case a door wing, is fastened to a single axis hinge 3 through the rapid mounting hinge cup, the single axis hinge comprising a hinge arm 5 and being pre-mounted to a cupboard. The free end of the hinge arm 5 is provided with a mounting member 7 slit orthogonal to the pivot axis 10 of the single axis hinge 3, the mounting member being adapted to be fixed by means of a fastening screw 42 of the cup body 2. To this avail, the fastening screw 42 is unscrewed far enough, as is best seen in FIG. 3, that the mounting member 7 can be pushed under the screw head of the fastening screw 42.

Figure 6:
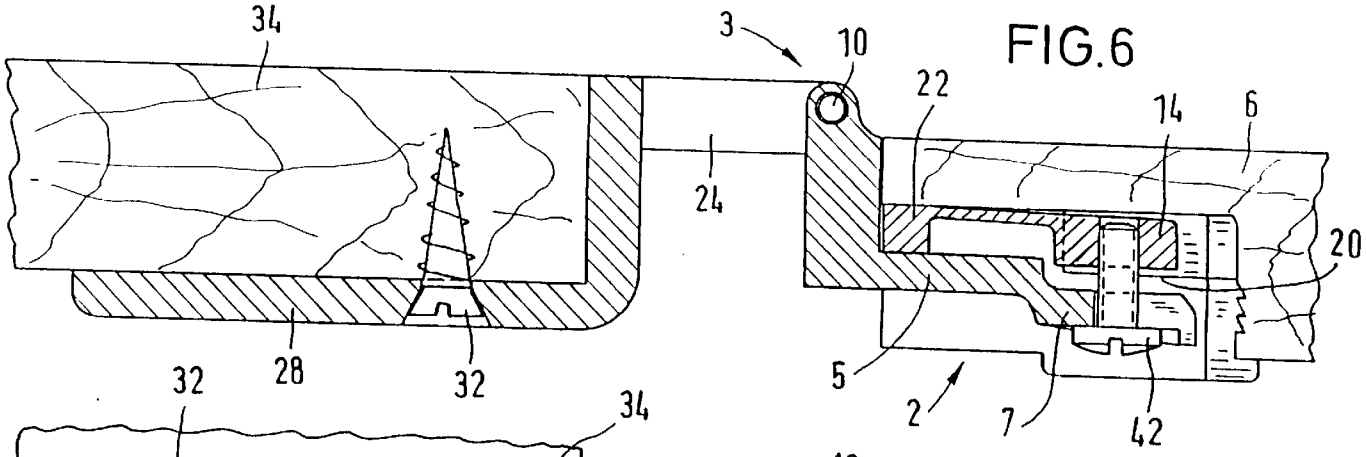
FIG. 6 shows a sectional view along line VI—VI in FIG. 5.
Figure 5:
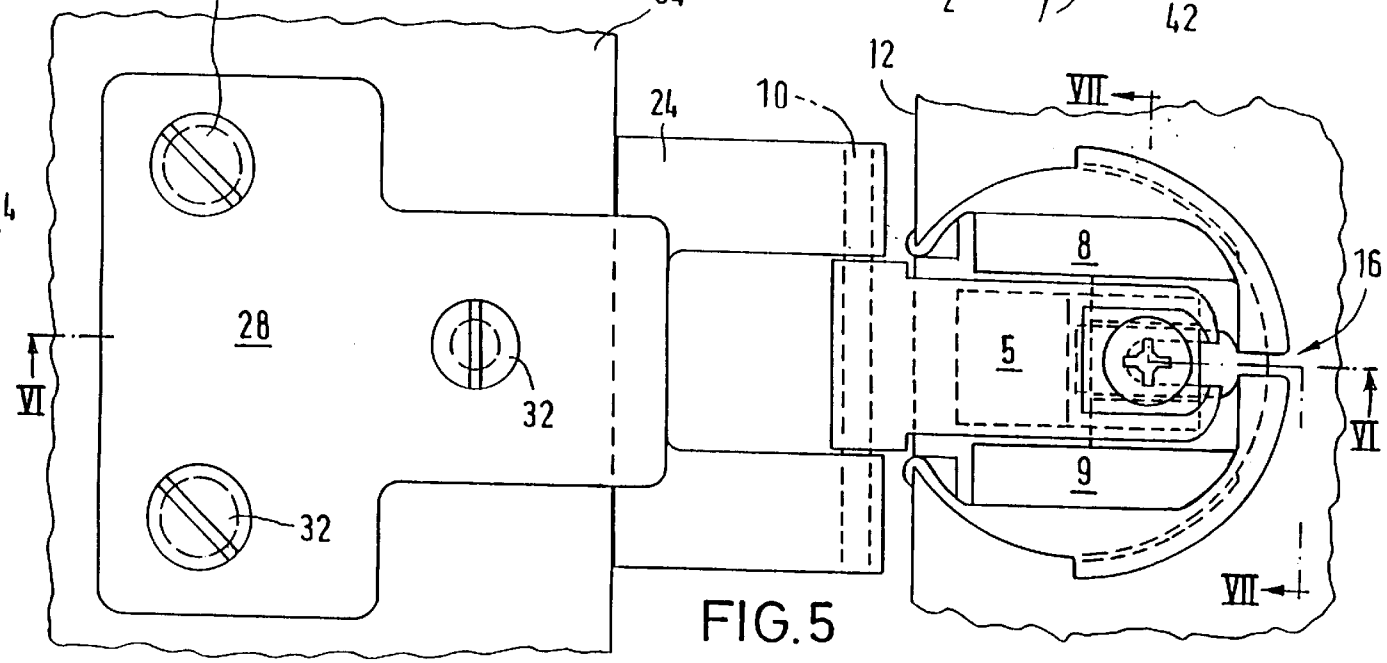
FIG. 5 is a view similar to FIG. 4, showing the assembled state prior to the tightening of the spreader element.
Figure 7:
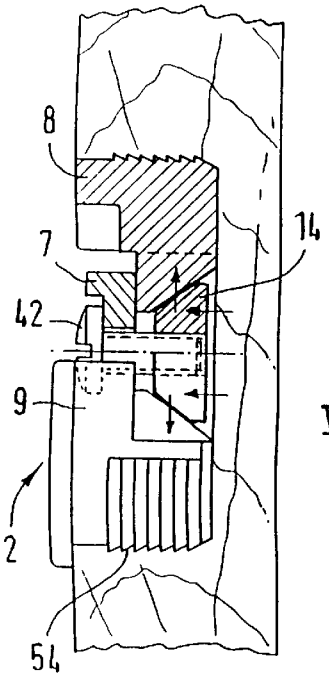
FIG. 7 shows a sectional view along line VII—VII in FIG. 5.

FIGS. 5 to 7 illustrate the single axis hinge 3 in the assembled state after the rapid mounting hinge cup has been pushed onto the hinge arm 5 in the direction of the arrow, as is shown in FIG. 4.

The cup body 2 of the rapid mounting cup comprises two mirror symmetric cup halves 8, 9 integrally connected through a web 22 extending in parallel to the inner door edge 12. Both cup halves 8, 9 are mirror symmetric to a plane extending through the hinge axis 10 and the central axis of the cup bore 4. They are connected only through the web 22 so that a slit 16 remains free on the side opposite the web 22.

A spreader element 14 is formed integrally to the web 22 and may be braced against both cup halves 8, 9 to spread these apart so that the outer cup walls with their cupped gripping points 54 are firmly pressed into the cup bore 4 and securely fasten the cup body 2 in the same.

It is evident that the spreader element 14 may be a separate member, in contrast to the illustrations in FIGS. 1 to 12.

Both cup halves 8, 9 have a supporting surface 20 for receiving the mounting member 7, wherein, in the embodiment shown in FIGS. 1 to 6, the fastening screw 42 simultaneously serves to fasten the hinge arm 5 and as a tensioning element 18 for tightening the spreader element 14.

As is best seen from FIG. 7, both, the cup halves 8, 9 and the spreading element 14 comprise mutually adapted beveled surfaces orientated at such angles with respect to each other that upon bracing the spreader element 14 against the cup halves 8, 9, the fastening screw 42 exerts radially acting forces on the cup halves 8, 9.

The hinge arm 5 of the single axis hinge 3 is hinged to a forked member 25 through the hinge axis 10, the forked member being connected to a mounting flange 28. The mounting flange 28 is fastened to a wall 34 of the piece of furniture by means of fastening screws 32.

Figure 9:
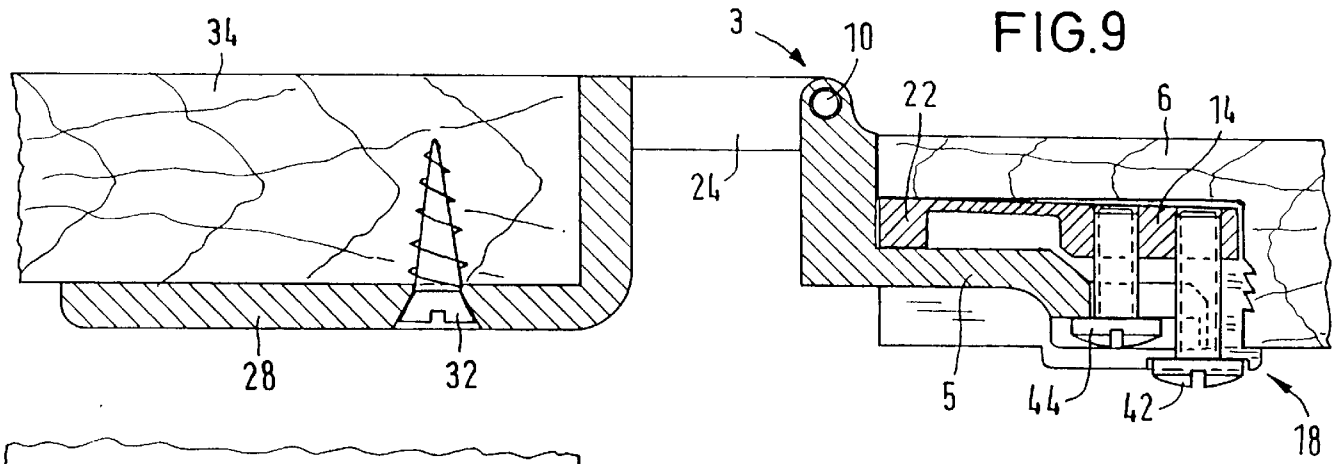
FIG. 9 is a sectional view along line IX—IX in FIG. 8.
Figure 8:
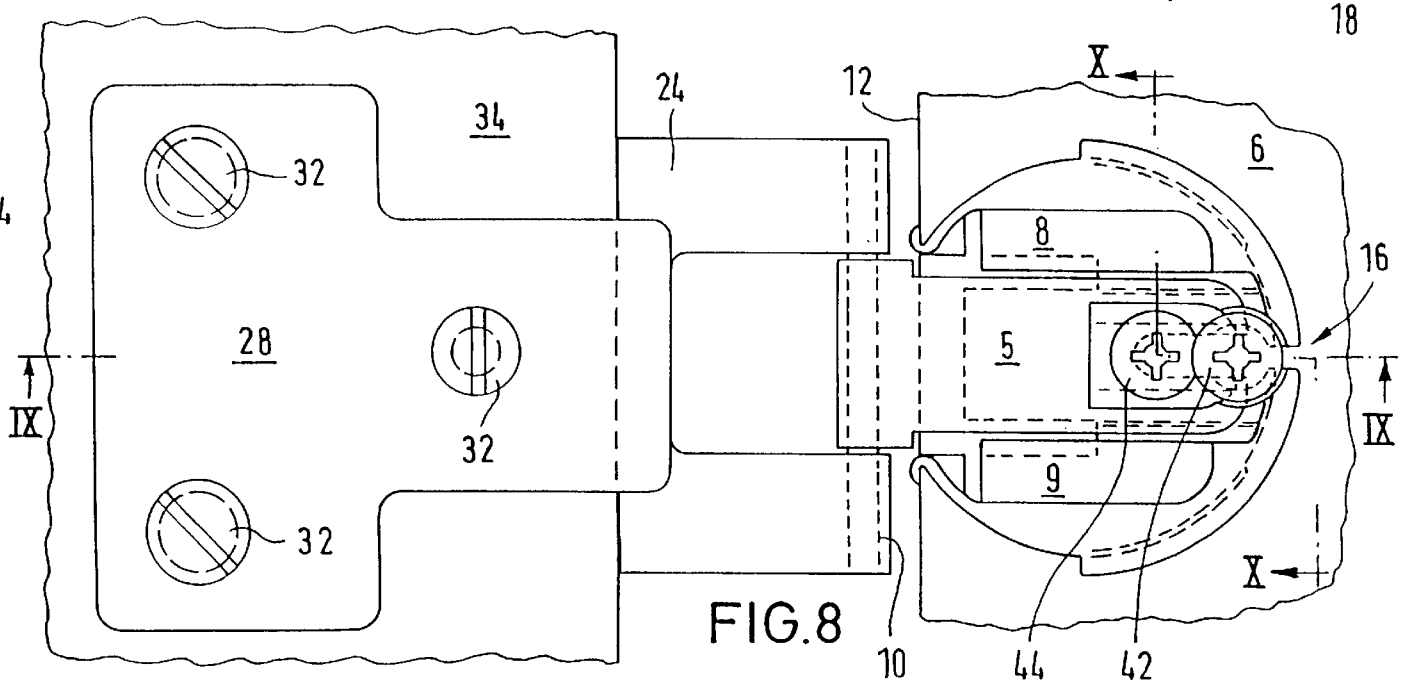
FIG. 8 illustrates a second embodiment with a separate mounting of the single axis hinge.
Figure 10:
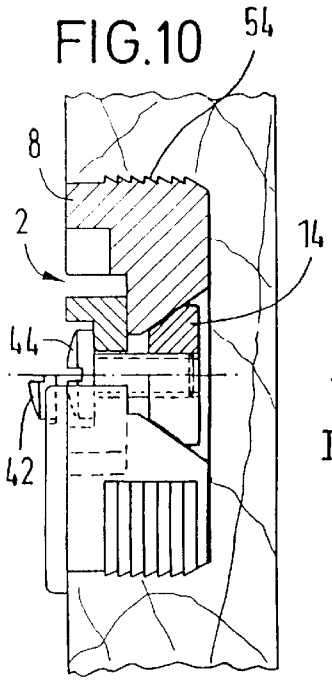
FIG. 10 is a sectional view along line X—X in FIG. 8.

FIGS. 8 to 10 illustrate an embodiment wherein the functions of the fastening screws 42 of the first embodiment are distributed to two fastening screws 42, 44. The fastening screw 44 only serves to fasten the hinge arm 5, whereas the fastening screw 42 serves as a tensioning element 18 for tightening the spreading element 14. In this manner, each screw is occupied only with its proper function and no interferences can occur.

Figure 12:
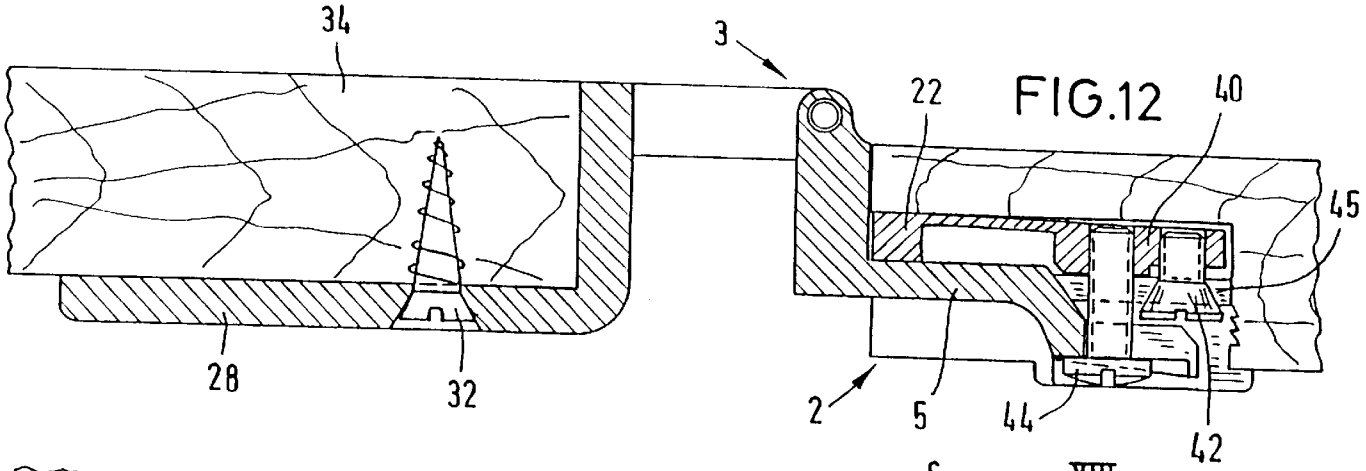
FIG. 12 shows a sectional view along line XII—XII in FIG. 11.
Figure 11:
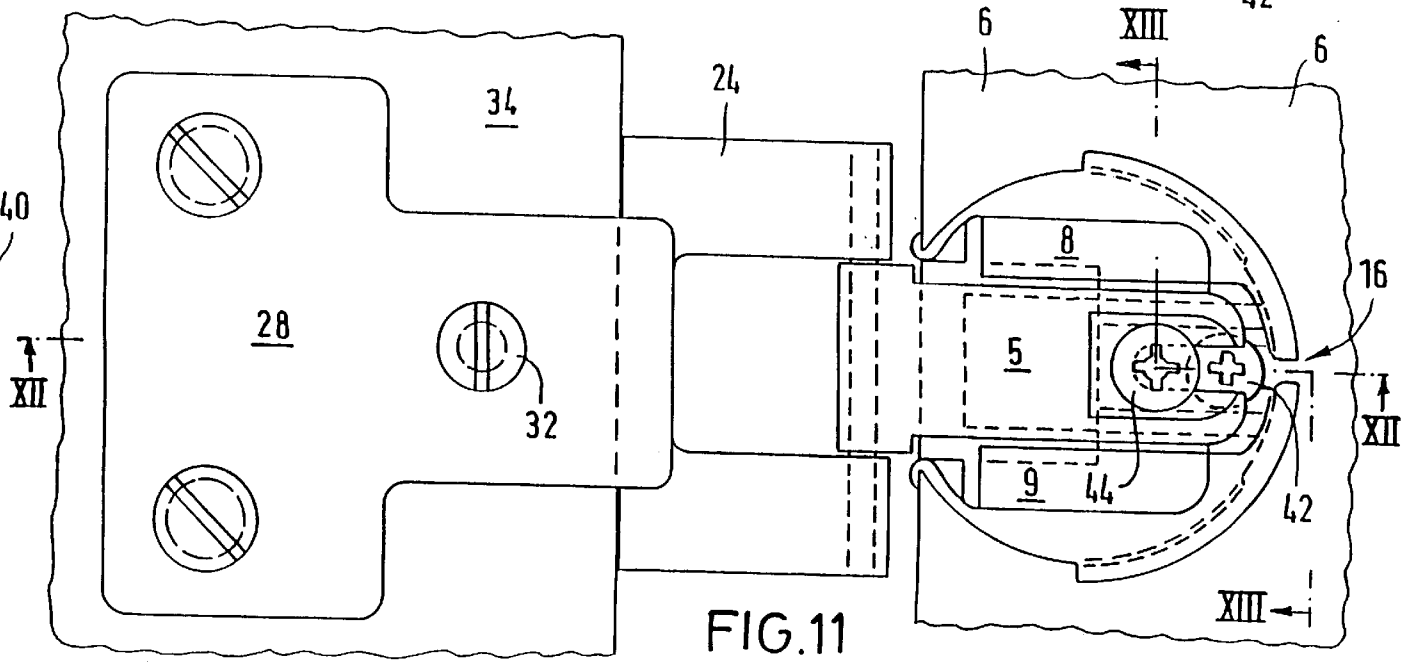
FIG. 11 illustrates a further embodiment of the invention.
Figure 13:
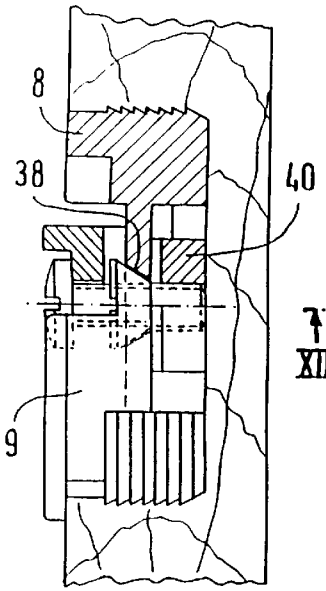
FIG. 13 shows a sectional view along line XIII—XIII in FIG. 11.

FIGS. 11 to 13 illustrate another embodiment with separate fastening screws 42, 44 for fastening the hinge arm 5 and for spreading the cup halves 8, 9 apart. As is best seen in FIG. 13, the cup halves 8, 9 are spread apart by means of the fastening screw 42 having a conic head portion that, when the screw is screwed into a tongue member 40 projecting from the web 22, abuts against correspondingly inclined beveled surfaces 38 of the cup halves 8, 9 so that upon screwing in the fastening screw 42, the cup halves 8, 9 are spread apart.

Figure 14:
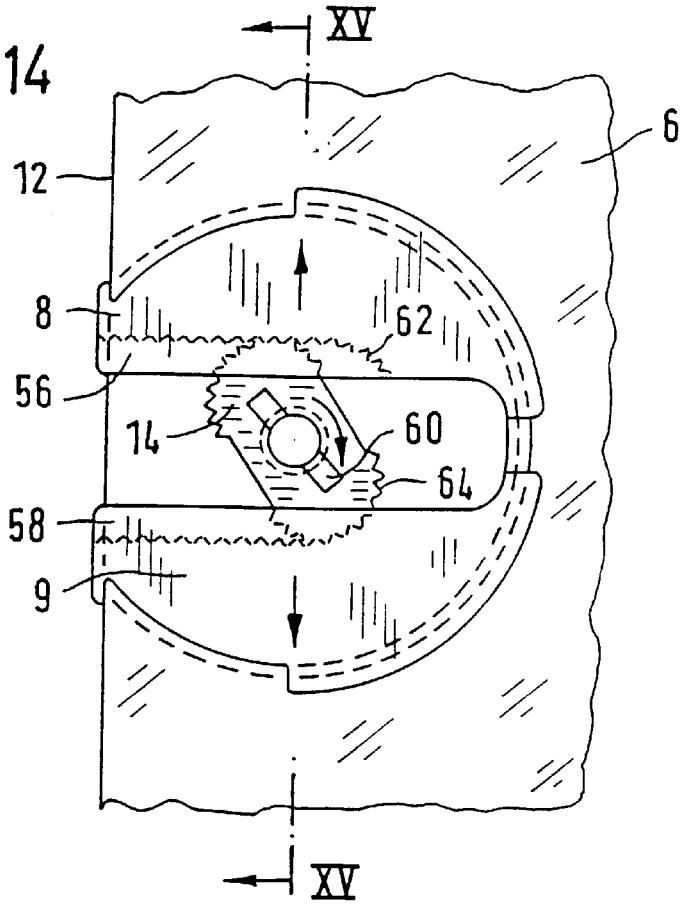
FIG. 14 illustrates another embodiment of the invention.
Figure 15:
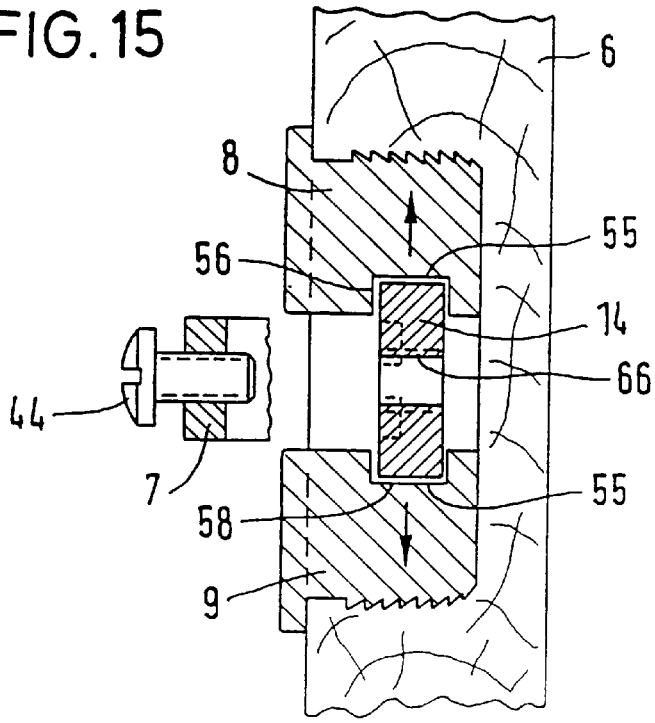
FIG. 15 is a sectional view along line XV—XV in FIG. 14.

FIGS. 14 and 15 illustrate a further embodiment wherein the spreader element 14 is a separate element movable in opposite grooves 56, 58 of the cup halves 8, 9. The spreader element 14 operates in the manner of an eccentric lever and is of elongate shape, the length of the spreader element being slightly larger than the mutual distance of the groove bottom 55 of the grooves 56, 58. The transversal axis of the spreader element 14 is substantially smaller than the longitudinal axis so that the element is freely movable in the grooves. The grooves 56, 58 extend in parallel to the bottom of the cup body 2 and orthogonal to the inner door edge 12.

The spreader element 14 has a screw driver slot 60 provided in the lengthwise direction, whereby the spreader element 14 may be turned within the grooves 56, 58. Since the spreader element 14 is longer than the mutual distance between the groove bottoms 55 of the grooves 56, 58, the cup halves 8, 9 are spread apart. The groove bottom 55, as well as the other end faces of the spreader element 14 may be provided with a fluted design 62, 64 adapted to each other so that a spread position once taken by the cup halves 8, 9 can be fixed by means of the fluted design 62, 64.

The mounting member 7 of the single axis hinge 3 may be fastened to the spreader element 14 by means of the fastening screw 44. To do so, the spreader element 14 has a threaded bore 66 for receiving the fastening screw 44.

Figure 16:
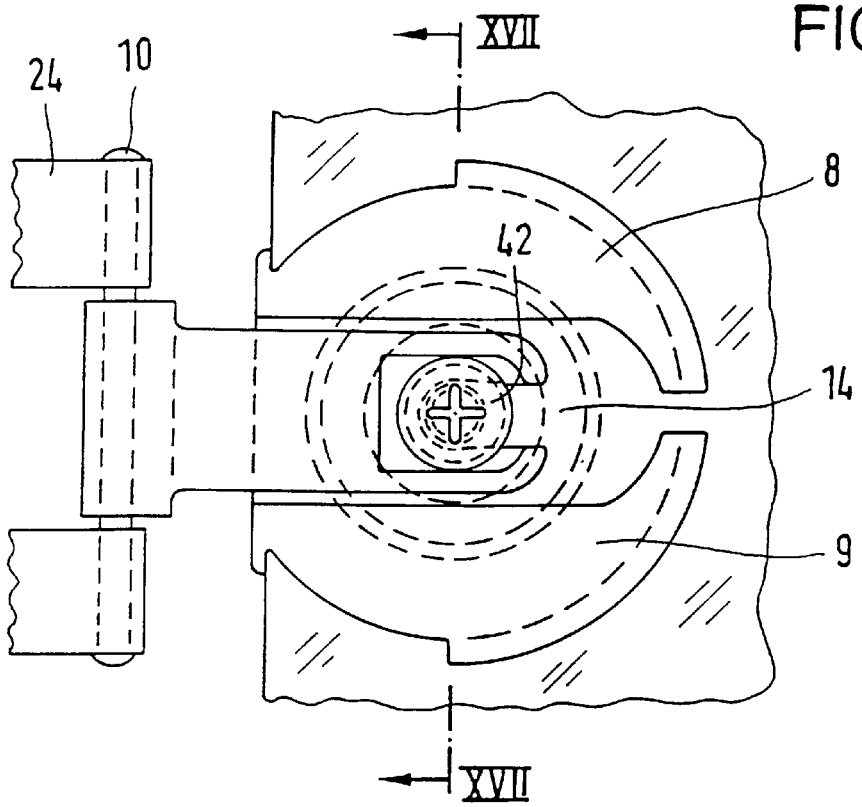
FIG. 16 illustrates another embodiment of the invention.
Figure 17:
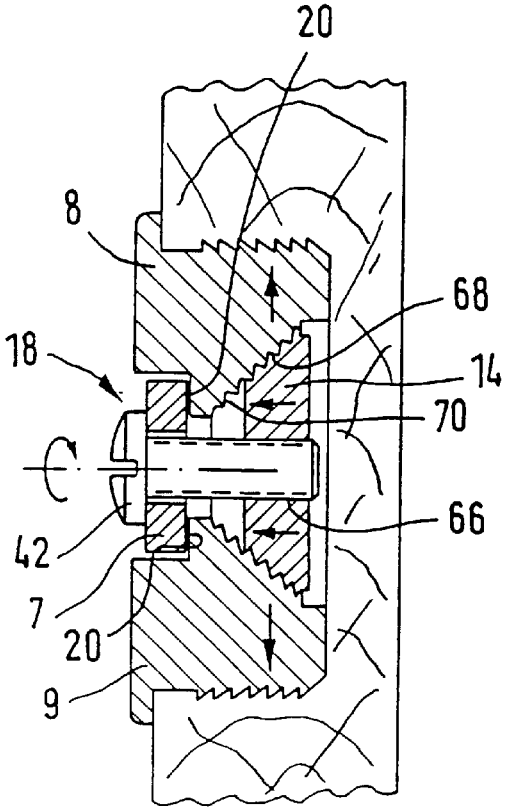
FIG. 17 is a sectional view along line XVII—XVII in FIG. 16.

In the embodiment of FIGS. 16 and 17, the spreader 14 is frustoconic in shape and is provided with step-like notches 68 around its radial periphery, which notches cooperate with corresponding notches 70 of a corresponding beveled surface of a recess in the cup halves 8, 9. The step-like notches 68, 70 extend conically so that, when tightening the spreader element 14 through the fastening screw 42 serving as a tensioning element 18 and through a concentric threaded bore 66 in the spreader element 14, spreading the cup halves 8, 9 apart is facilitated and the spreader element 14 can catch at the next step, respectively. Using the fastening screw 42, the mounting member 7 of the single axis hinge 3 is further fastened on the supporting surfaces 20 of the cup halves 8, 9.

It is evident that the spreader element 14 may have no peripheral steps but a smooth outer surface, preferably extending under an angle of 45°.

I claim:

1. A rapid mounting for furniture hinges comprising a substantially cylindrical cup body (2) adapted for insertion into a cup bore (4) of a piece of furniture (6) and for being locked in said cup bore (4), said substantially cylindrical cup body (2) being defined by a center axis and including two substantially symmetrical mirror-image cup halves (8, 9), said cup halves (8, 9) having substantially adjacent diametric portions and remote peripheral portions with said peripheral portions being adapted to be brought into locking engagement with said cup bore (4), a plane of symmetry of said cup halves (8, 9) passing through said center axis substantially medially of said diametric portions, a spreader element (14) disposed substantially between said cup halves (8, 9) with said plane of symmetry passing therethrough, and said spreader element (14) including means (42) for spreading the cup halves (8, 9) apart in radial directions opposite to said plane of symmetry by moving said spreader element (14).

2. The rapid mounting hinge cup as defined in claim 1 wherein said spreading means (42) functions as a tensioning element (18).

3. The rapid mounting hinge cup as defined in claim 2 wherein said tensioning element (18) is a screw (42) screwed into said spreader element (14).

4. The rapid mounting hinge cup as defined in claim 2 wherein said spreading means (42) is carried by said spreader element (14).

5. The rapid mounting hinge cup as defined in claim 2 wherein said spreading means (42) is rotatably carried by said spreader element (14).

6. The rapid mounting hinge cup as defined in claim 2 wherein said tensioning element (18) is a screw (42) screwed into said spreader element (14), and said diametric portions include beveled surfaces (26, 30, 34, 38) against which bear beveled surfaces of said spreader element (14).

7. The rapid mounting hinge cup as defined in claim 6 wherein said beveled surfaces (26, 30) define a substantially frusto-conical configuration to said spreader element (14).

8. The rapid mounting hinge cup as defined in claim 7 wherein said beveled surfaces are stepped.

9. The rapid mounting hinge cup as defined in claim 8 wherein said steps are beveled conically.

10. The rapid mounting hinge cup as defined in claim 1 comprising web means (22) between said diametric portions for connecting said cup halves (8, 9) to each other, and said spreading means (42) of said spreader element (14) deforms said web means (22) upon the spreading apart of said cup halves (8, 9).

11. The rapid mounting hinge cup as defined in claim 1 including web means (22) between said diametric portions for connecting said cup halves (8, 9) to each other, and said spreader element (14) projects from said web means (22).

12. The rapid mounting hinge cup as defined in claim 1 wherein said diametric portions of said cup halves (8, 9) include beveled surfaces (26, 30).

13. The rapid mounting hinge cup as defined in claim 1 wherein said cup body (2) includes a flange (46) having at least one centering pin.

14. The rapid mounting hinge cup as defined in claim 1 wherein said cup body (2) includes edge protection strips (52).

15. The rapid mounting hinge cup as defined in claim 1 wherein said peripheral portions of said cup halves (8, 9) include saw-shaped gripping points (54).

16. The rapid mounting hinge cup as defined in claim 1 wherein said diametric portions of said cup halves (8, 9) include grooves (56, 58), and said spreading element (14) is an elongated operator member received in and between said opposite grooves (56, 58).

17. The rapid mounting hinge cup as defined in claim 1 wherein said diametric portions of said cup halves (8, 9) include grooves (56, 58), said spreading element (14) is an elongated operator member received in and between said opposite grooves (56, 58), and said elongated operator member includes surfaces corresponding in configuration to the configuration of said grooves (54, 56).

18. The rapid mounting hinge cup as defined in claim 1 wherein said spreader element (14) is rotated by said spreading means (42).

19. The rapid mounting hinge cup as defined in claim 1 wherein said spreader element (14) is of a frusto-conical configuration housed in a recess of said cup halves (8, 9), and said spreading means (42) functions as a tensioning element (42) for drawing said spreader element (14) against said recess of said cup halves (8, 9).

* * * * *